US006337618B1

(12) United States Patent
Craig et al.

(10) Patent No.: US 6,337,618 B1
(45) Date of Patent: Jan. 8, 2002

(54) PROGRAMMABLE ELECTROMECHANICAL LOCK WITH DIGITAL DISPLAY

(76) Inventors: James J. Craig, 785 Harbour Dr., Boca Raton, FL (US) 33431; Francisco Castellanos; Ziomara Castellanos, both of 1345 NE. 135th St., North Miami, FL (US) 33161

( * ) Notice: Subject to any disclaimer, the term of this patent is extended or adjusted under 35 U.S.C. 154(b) by 0 days.

(21) Appl. No.: 09/414,183

(22) Filed: Oct. 7, 1999

(51) Int. Cl.[7] ..... G08B 19/00
(52) U.S. Cl. ..... 340/5.22
(58) Field of Search ..... 340/5.22, 5.26, 340/5.64, 5.51, 5.7–5.73; 70/279, 277–280, 281–283, 275; 379/102.06; 361/172

(56) References Cited

U.S. PATENT DOCUMENTS 4,495,540 A * 1/1985 Remington et al. ..... 361/172
5,628,216 A * 5/1997 Qureshi et al. ..... 70/279
5,815,557 A * 9/1998 Larson ..... 379/102.06

FOREIGN PATENT DOCUMENTS

GB 2144483 A * 3/1985 .... E05B/67/00 ...

* cited by examiner

*Primary Examiner*—Michael Horabik
*Assistant Examiner*—William L. Bangachon
(74) *Attorney, Agent, or Firm*—Robert M. Downey

(57) ABSTRACT

An electromechanical lock includes a housing containing a microcontroller, a power source, a cam, and a locking lever for holding a U-shaped lock bar in a closed, locked position within the housing. The lock further includes several buttons on the housing for entering a sequence of alphanumeric characters of a combination code and a Liquid Crystal Display (LCD) for showing the alphanumeric characters, independently, when entering the code. Messages may also be displayed, including advertisements and company logos, upon completion of a correct code entry to open the lock. The microcontroller stores one or more combination codes and message data and controls actuation of the cam, upon entry of the correct combination code, to momentarily release the lever from the lock bar, allowing the lock bar to be pulled out from the housing, thereby opening the lock. In another embodiment, the lock is further provided with a transceiver and an antenna for wireless communication with a provider of the lock, thereby allowing the provider to change and/or update stored message data and to remotely program and manipulate data stored on the microcontrollers of a large number of the electromechanical lock units throughout a vast geographical area of distribution.

21 Claims, 10 Drawing Sheets

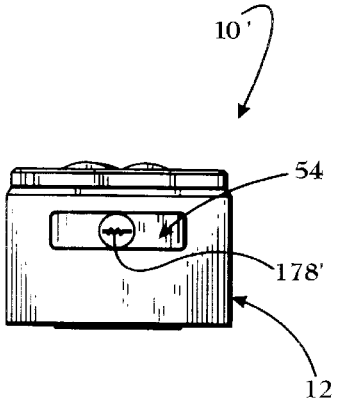
FIG. 17A
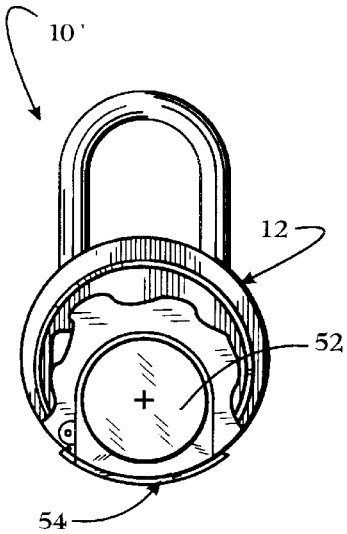
FIG. 17B
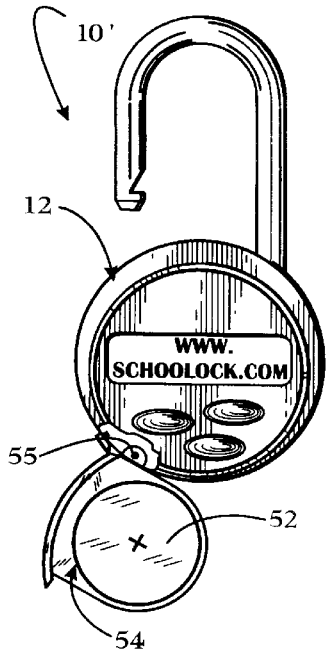
FIG. 17C
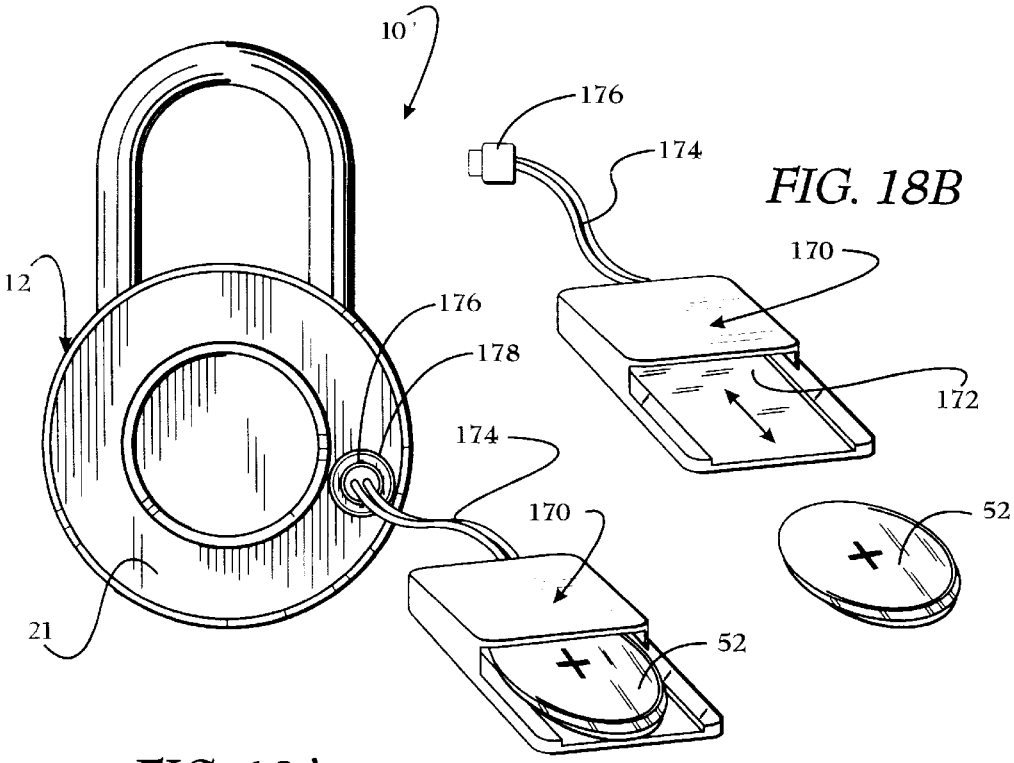
FIG. 18B
FIG. 18A

PROGRAMMABLE ELECTROMECHANICAL LOCK WITH DIGITAL DISPLAY

BACKGROUND OF THE INVENTION

1. Field of the Invention

The present invention relates to an electromechanical lock including an LCD, a microcontroller, a lock bar and means for releasing the lock bar to permit opening of the lock upon entering a correct combination using one or more buttons. The invention further relates to a lock device which is provided with a transceiver and an antenna for wireless communication with a lock provider or advertising service in order to facilitate remote programming and manipulation of data on the microcontroller, wherein a message (e.g., an advertisement) appears on the lock's display upon completing entry of a correct combination code to open the lock.

2. Description of the Related Art

The art is crowded with numerous combination locks of various style and structure. In particular, a mechanical combination lock comprising a steel housing with a rotatable combination dial on the front face and a U-shaped steel locking bar is well known in the art. This type of lock, sold primarily under the trademark "MASTERLOCK," was first introduced to the market many years ago and remains in widespread use to this day. The rotating dial combination lock is used extensively by students between 6–22 years of age for securing lockers in schools and locker rooms, as well as for locking storage trunks, gates and bicycles.

One problem with existing mechanical combination locks is that they usually require two hands in order to enter the combination and pull the lock open. Furthermore, manually rotating a dial through numerous revolutions, both clockwise and counterclockwise, can be confusing and often times one has to make several attempts at entering the combination to open the lock. Additionally, the purely mechanical structure makes it easier to pick this type of lock.

In the present market of the approaching new millennium, wherein consumers thrive on high technology products, the purely mechanical rotating dial combination lock is viewed as a kind of relic, much like the rotating dial telephone appears to be when compared to the modern push button digital phone. The antiquated structure of this style combination lock is especially realized by today's teenagers who, having grown up in the emerging high tech computer era, are accustomed to push button entry and digital display features for a vast array of devices, including watches, stereo equipment, handheld computers, pagers, and cellular phones. And yet, despite significant advances in other product fields, combination locks, particularly those used by students, have remain unchanged for more than 30 years. The seemingly antique nature of the rotating combination entry dial, which is awkward to many of today's youths, limits the usefulness and capabilities of this style lock in the present high technology environment.

Accordingly, there is a need in the art for an improved combination lock, of the type including a housing and a U-shaped lock bar which releases from the housing, wherein the combination is entered using push buttons and, further wherein the alphanumeric characters of the combination, product logos, messages, advertisements and other indicia, may be shown on an LCD. There is a further need for an electromechanical lock which is provided with push button entry means, an LCD and wireless communication means for remote programming and manipulation of data stored on a microcontroller/microprocessor in the lock, thereby permitting a large number of lock units to be programmed with updated messages, such as advertisements, from a central location.

3. Objects of the Invention

It is a primary object of the present invention to provide a programmable electromechanical lock which includes a liquid crystal display and wherein the lock is specifically structured to permit push button entry of alphanumeric characters of a combination code to thereby facilitate ease of operation to open the lock.

It is also a primary object of the present invention to provide a programmable electromechanical lock with a liquid crystal display and including means for storing messages, including advertisements, company logos, and other graphics, wherein one or more messages are displayed upon completion of entry of a correct code to open the lock.

It is another object of the present invention to provide a programmable electromechanical lock with a liquid crystal display, wherein the lock is provided with a transceiver and an antenna for wireless communication with a central programming station, thereby allowing a provider of the lock to change and/or update stored message data and to remotely program and manipulate data stored in the memory means of the lock.

It is still a further object of the present invention to provide a programmable electromechanical lock with a liquid crystal display, wherein a provider of the lock can remotely program and manipulate data stored on the microcontrollers of a large number of the electromechanical lock units throughout a vast geographical area of distribution.

It is still a further object of the present invention to provide a programmable electromechanical lock with a liquid crystal display, wherein a provider of the lock is able to remotely change and/or update stored message data on a large number of the electromechanical lock units throughout a vast geographical area of distribution, thereby allowing messages which are displayed on the lock units to be simultaneously changed or updated at periodic intervals selected by the provider.

It is still a further object of the present invention to provide a programmable electromechanical lock with a liquid crystal display which is specifically structured to be energy efficient, thereby providing an extended useful battery life and allowing for thousands of operating sequences of the lock over an extended period of time.

It is still a further object of the present invention to provide a programmable electromechanical lock with a liquid crystal display which includes means to prevent unauthorized removal of the power source when the lock is in a locked condition.

It is yet a further object of the present invention to provide a programmable electromechanical lock with a liquid crystal display which is specifically structured to store a plurality of combination codes including a permanent factory installed code and one or more programmable user codes selected by the individual user of the lock.

It is a further object of the present invention to provide a programmable electromechanical lock with a liquid crystal display which is specifically structured to include multiple diagnostic functions for factory use and user functions including the ability to set the correct time, to change the contrast of the display, and to program personal user combination codes which overlay a permanent factory code.

It is still a further object of the present invention to provide a programmable electromechanical lock with a liquid crystal display which provides a means for advertising to a captive audience.

SUMMARY OF THE INVENTION

The present invention is directed to an electromechanical lock which includes a housing with a front face, a plurality of push buttons on the front face, and a U-shaped lock bar having a first end movably fixed within the housing and a second end which is releasably separable from the housing to open the lock. The lock further includes an LCD on the front face and an internal electrically programmable microcontroller communicating with the LCD, the push buttons, and a lock release assembly structured for releasable interlocking with the second end of the lock bar within the housing. The microcontroller stores one or more combination codes, including a permanently preprogrammed identifiable factory code which is burned into memory and at least one user programmable code which is entered using the buttons on the front face of the lock. The lock release assembly includes a locking lever structured and disposed for movement into locked engagement with the second end of the lock bar in order to secure the lock bar in a closed, locked position so that both ends are captured within the housing. A cam engages the locking lever for moving the lever into and out of locked engagement with the end of the lock bar. The lock is opened by entering the combination, using the buttons. As the user enters the code, the display momentarily indicates each character of the code, independently of the other characters. As each subsequent character of the combination is entered, the previous entered character disappears from the display. The removed character (after entry) may be replaced with a dash, dot, star or other symbol to indicate to the user that the character placement has been entered. The microcontroller compares the entered code with the programmed codes and, if a match is achieved, the microcontroller signals actuation of the electromechanical device, such as a motor/solenoid, causing the cam to rotate and release the locking lever, thereby allowing the locked bar to be pulled open from the housing.

In another embodiment, the lock is further provided with a transceiver and an antenna to facilitate wireless communication. In particular, it is contemplated that a plurality of locks, incorporating wireless communication capabilities, are to be distributed by a provider, such as an advertising, internet and/or communications company. In this embodiment, the provider is able to remotely communicate with each of the plurality of lock units from a central location.

BRIEF DESCRIPTION OF THE DRAWINGS

For a fuller understanding of the nature of the present invention, reference should be made to the following detailed description taken in conjunction with the accompanying drawings in which:

FIG. 14A is a rear elevational view of the lock, in accordance with the embodiment of FIGS. 6 and 7, showing the components of the lock release assembly (a spur gear is removed for purposes of clarity) in a locked position to secure the U-shaped lock bar closed with both ends of the lock bar captivated within the housing, thereby defining a locked condition;

FIG. 17A is a bottom plan view of the lock in accordance with one preferred embodiment thereof;

FIG. 17B is rear elevational view, in partial cutaway, illustrating a battery and battery carriage within the lock housing in accordance with one preferred embodiment thereof;

FIG. 17C is a front elevational view of the embodiment of FIG. 17A showing the battery and battery carriage removed from the lock housing;

FIG. 18A is a rear perspective view of the lock showing an auxiliary battery pack plugged into the lock housing for providing power to the components thereof;

FIG. 18B is a perspective view of the auxiliary battery pack showing a battery being removed therefrom;

Like reference numerals refer to like parts throughout the several views of the drawings.

DETAILED DESCRIPTION OF THE PREFERRED EMBODIMENTS

Figure 1:
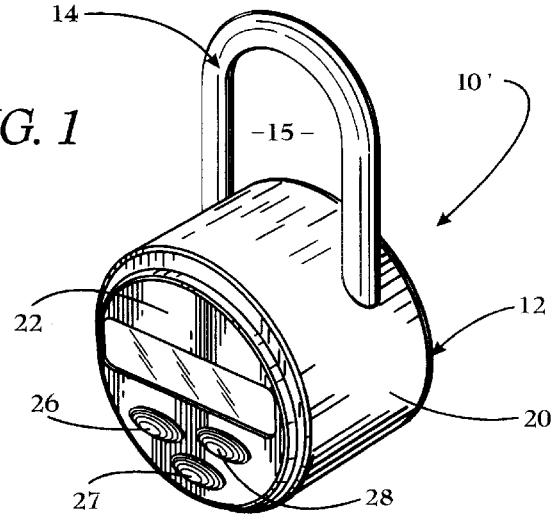
FIG. 1 is a perspective view of the electromechanical lock of the present invention, in accordance with one embodiment thereof.

Referring to the several views of the drawings, several preferred embodiments of the electromechanical lock of the present invention are shown and generally indicated as 10, 10' and 10". In each of the embodiments, the lock includes a housing 12 and a U-shaped lock bar 14 having a first end portion 16 which is movably retained within the housing of the lock and an opposite second end portion 18 having a notch 19 formed on an inner facing side in spaced relation from the distal end. The notch 19 is structured and disposed for releasable, interlocked engagement with a lock release assembly within the housing. Accordingly, when the lock bar is in a locked position, both end portions 16 and 18 remain captured within the housing so that the U-shape lock bar encloses an area 15 between the lock bar 14 and the housing 12 in the same general manner as conventional locks which use a U-shaped lock bar.

In the preferred embodiments, the housing 12 has a generally round configuration with a cylindrical side wall 20, and a back plate 21 which is fixed to the cylindrical side wall. The cylindrical side wall and back plate are formed of hardened steel or, alternatively, a durable plastic or other material which is resistant to impact, to thereby maintain the integrity of the lock. The housing further includes a front face 22 which is fitted within an annular rim 24 at the forward end of the side wall. In a preferred embodiment, the front face 22 is formed of translucent/clear polycarbonate. However, it is contemplated that other materials may be used for the front face, including steel for providing added security against tampering and to possibly reduce the manufacturing costs. The disk-shaped face is sized for congruent receipt within the annular rim of the housing and includes cutout portions to permit passage of a plurality of buttons therethrough.

Figure 2A:
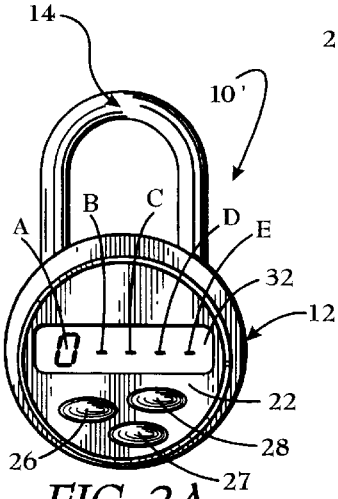
FIGS. 2A–2E illustrate, in sequence, the manner of combination code entry and display of the individual entered digits when opening the lock.
Figure 2B:
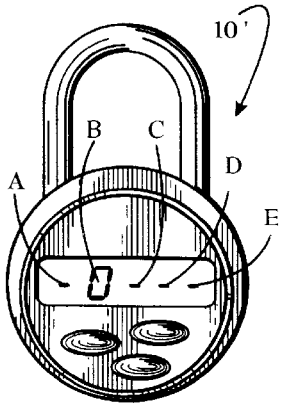
Figure 2C:
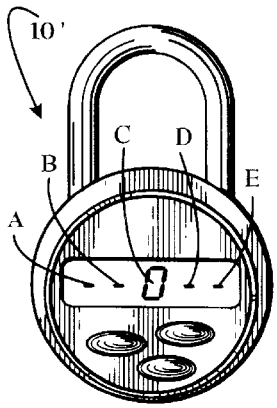
Figure 2D:
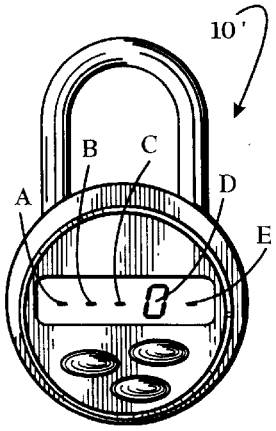
Figure 2E:
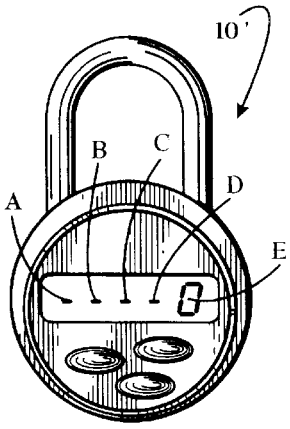

In the preferred embodiment, the device is provided with three buttons, including an increment button 28, a decrement button 27, and a select button 26. To enhance the appearance of the front face, a membrane may be inserted behind the polycarbonate clear face. In particular, an acetate material provides a suitable membrane 30 to print colorful logos, graphics and/or text thereon. A window 31 is provided in the membrane to expose a liquid crystal display (LCD) 32 through the front face 22. The display 32 provides visual indication of each of the entered characters, for a plurality of character placements A–E, using the buttons 26, 27 and 28. Specifically, FIGS. 2A–2E show a sequence of character entry placements A–E used for entering the combination code of the lock. Use of five character placements allows for over 60 million different combinations. Beginning with the first character placement A, shown in FIG. 2A, the user can advance from the zero digit through the nine digit and/or through each letter of the alphabet using the increment button 28 to reach the desired alphanumeric character of the first character placement A. Alternatively, the user can use the decrement button 27 to decrease the characters at each character placement. Upon reaching the desired alphanumeric character (0–9 and/or capital A–Z) for each character placement, the select button 26 is depressed. Upon depressing the select button, the character at that specific character placement is entered and saved, and the next succeeding character placement is displayed. For security purposes, each character placement is shown independently, while the other character placements remain blank (showing a dash, star or other symbol). For instance, in FIG. 2A, the character is displayed at the first character placement A, while the remaining character placements B–E are left with a dash. The user can then scroll up or down, from zero through Z, at this specific character placement A, until the desired character is displayed. Upon depressing the select button 26, the entered character is removed and replaced with a dash, and the next succeeding character placement B is activated to initially reveal the zero digit, as seen in FIG. 2B. The user can then scroll through the characters (0–9 and A–Z) at this placement until the desired character is reached. The select button 26 is then depressed to enter this selected character of the code. This sequence continues through the remaining character placements C–E, as seen in FIGS. 2C through 2E, until all characters of the code are entered, at each character placement.

Figure 2F:
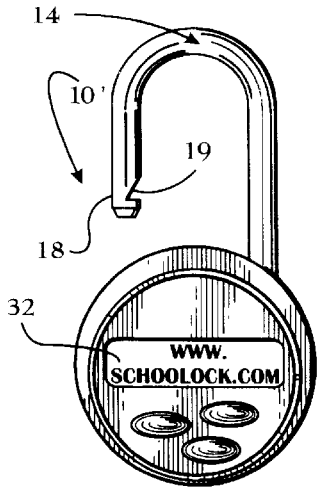

The display 32 may further be used to show messages, including advertisements, product or company logos, telephone numbers, and the like. FIG. 2F shows one particular example of the display used to advertise a website for the internet. In one preferred embodiment, the messages, including advertisements, are displayed at the time of completion of entry of the last character of the code when the user is focused on the display. The same message may be repeated at each opening of the lock or, alternatively, a plurality of messages (e.g., advertisements) may be programmed in the device, wherein a different message is displayed each time the lock is opened. Thus, the displayed message, such as the one shown in FIG. 2F, is used to simultaneously convey information (e.g., an advertisement) to the user and to indicate to the user that the correct code has been successfully entered.

In accordance with preferred embodiments of the invention, the display 32 of the lock device 10, 10', 10" may be a segmented display, a character display, or a graphic liquid crystal display. The use of a graphic liquid crystal display (LCD) provides the widest array of visual options for advertising purposes. To reduce the stacking area required for the display 32, and to provide more room therein for other electronic components, an LCD (liquid crystal display) with COG (chip on glass) type display is preferred. The chip on the COG display 32 provides for simplicity of connection to an array of contacts associated with a PC board 51. In this embodiment, as shown in FIGS. 3B, 3C, 4, 6 and 7, the LCD is provided with a character generator for displaying character fonts and/or numerals in various sizes and/or languages.

In each of the various embodiments, shown throughout the several views of the drawings, the interior of the lock housing is provided with two primary chambers. Specifically, the lock interior includes an electronics chamber 40 in a forward portion of the lock housing, adjacent the front face 22 and display 32, and a lock chamber 42 within a rear portion of the housing which contains a plurality of components of a lock release assembly 44 for interlocking engagement with the second end 18 of the lock bar 14 within the lock chamber 42. The two primary chambers 40, 42 are separated by an interior dividing wall 76.

The electronics chamber 40 contains a plurality of electronic components including a power source 48 and a microcontroller 50. In the preferred embodiment, the power source 48 is a replaceable Lithium 3VDC power cell 52, which is commercially available through varied manufacturers. While this particular power source provides limited energy reserves, the remaining electronic components of the device have been specifically selected to work in conjunction with this power source, requiring minimal power consumption to thereby extend the useful life of the power source. The one or more power cells 52 are held within pockets on a carriage 54 which pulls out and removes from a bottom of the cylindrical wall structure 20 of the housing in order to facilitate replacement of the power cell(s) 52, when needed. The ability to remove the power cell(s) 52 is also a security feature, preventing operation of the lock by someone other than the lock owner. In the preferred embodiment, the carriage 54 is hinged to the housing at hinge point 55 enabling the carriage 54 to be pulled out from a bottom of the housing in the manner illustrated in FIG. 17C. Means are provided for preventing removal of the carriage from the housing until the lock bar 14 has been pulled open. Thus, when the lock bar 14 is secured in the locked position, the power cell 52 cannot be removed from the lock 10. Upon opening of the lock, by entering the proper combination and pulling the lock bar 14 outwardly from the housing 12, the carriage 54 is freed to enable the carriage to be pulled out and swung open about pivot point 55 in order to remove the power cell 52 from the lock device 10.

An auxiliary power supply is further provided, as shown in FIGS. 18A and 18B. Specifically, the auxiliary power source includes a power pack 170 which is provided with a port 172 for insertion of the power cell 52' therein. Energy from the power cell 52' is delivered from the power pack 170 through conductors 174 leading to plug 176 at the distal end of the conductors 174. The plug 176 is specifically structured for removable interconnection with a power supply port 178 on the lock housing 12. In one embodiment, the power supply port 178 is provided on the back plate 21 of the lock housing 12. Alternatively, a power supply port 178' may be provided on the carriage 54, as seen in FIG. 17A. The auxiliary power supply is particularly useful in the instance that the power cell 52 within the lock device dies while the lock device (10, 10', 10") is in the locked condition. More particularly, when the lock device is in the locked condition, the carriage 54 cannot be removed from the housing in order to replace the power cell 52. If the power cell 52 is dead, then it is necessary to connect the auxiliary power source, by attaching the plug 176 of the power pack 170 to the power supply port 178, to thereby deliver energy from power cell 52' in the power pack 172 to the electronic components of the lock device. This permits entry of the proper combination code (either the factory code or user code) to energize the lock release means and to thereby open the lock so that the carriage can be removed. The dead power cell 52 within the carriage 54 can then be replaced with a new power cell for continued use and operation of the lock device.

The microcontroller 50 in the electronics chamber 40 communicates with the push buttons, the display, and cam movement means 56 for actuating movement of the lock release assembly 44. The microcontroller 50 is programmable and, in a preferred embodiment, is provided with electrically erasable programmable random access memory (internal EEPROM). This allows for internal programming and manipulation of data stored on the microcontroller via wireless communication and/or a plug-in hard wired connection to a programming device, such as a computer. In each of the preferred embodiments, the microcontroller 50 is programmed with a factory combination code for opening the lock 10, 10', 10". It should be noted that, while a five character code is shown in the several drawing figures, the factory code and a user program code may be more or less than five characters, depending upon manufacturer costs and specifications. The factory code, which relates to the code permanently installed within the non-volatile memory, is preferably alphanumeric, using a series of digits/characters. In the event millions of the lock devices are manufactured, this type of coding enables programming of hundreds of millions different code combinations. As mentioned above, the user of the lock device has the option, at his/her discretion, to install a personal PIN code over the factory code, using the same alphanumeric coding. Programming of a personal PIN code or overlay code does not remove the factory code, and the user has the ability to use either the personal code or the factory code to open the lock.

Figure 6:
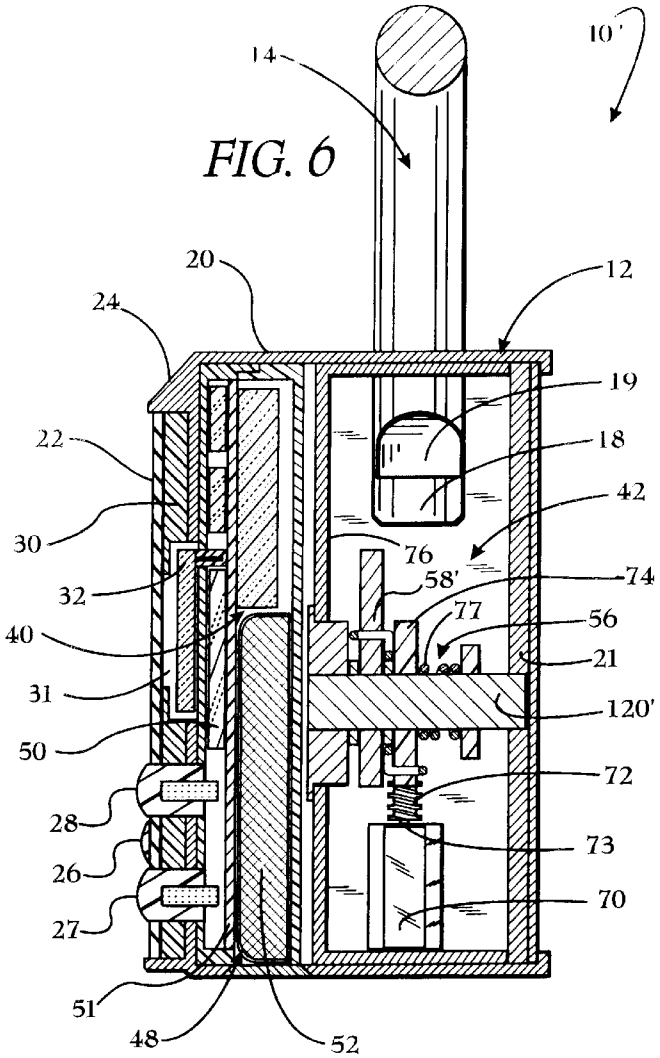
FIG. 6 is a side elevation, in cross section, showing the internal components of the electromechanical lock of the embodiment of FIG. 3B incorporating a motor and gear arrangement for moving a cam of the locking assembly.
Figure 5:
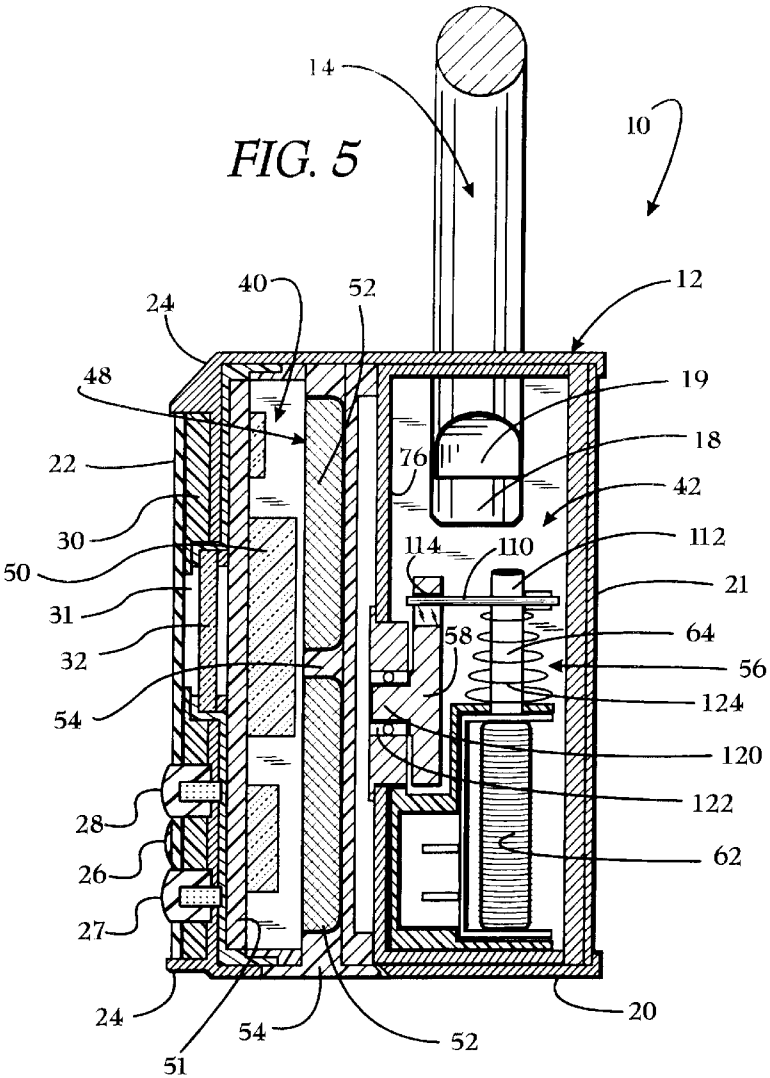
FIG. 5 is a side elevation, in cross section, showing the internal components of the electromechanical lock of the embodiment of FIG. 3B incorporating a solenoid actuating mechanism for moving a cam of the locking assembly.
Figure 12A:
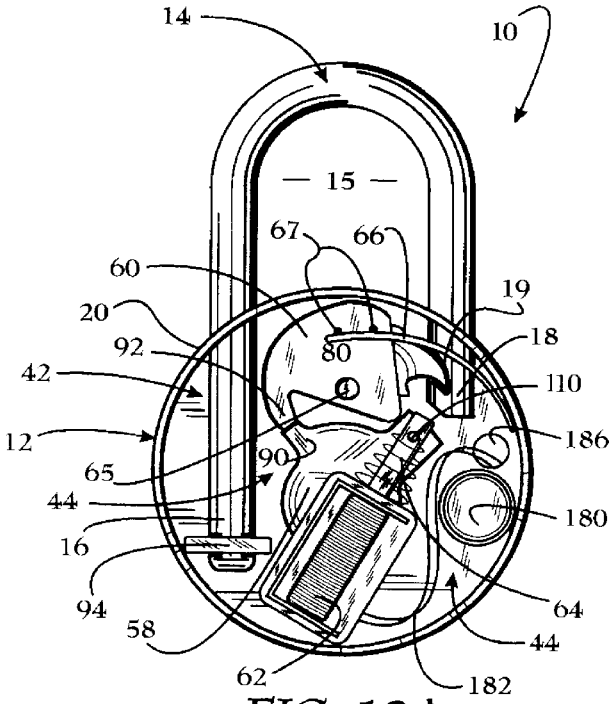
FIG. 12A is a rear elevational view of one embodiment of the lock, with the back removed, showing the components of the lock release assembly within the lock chamber of the housing, with the locking lever engaged with the end of the U-shaped lock bar in a closed position within the housing, and thereby defining a locked condition.
Figure 12B:
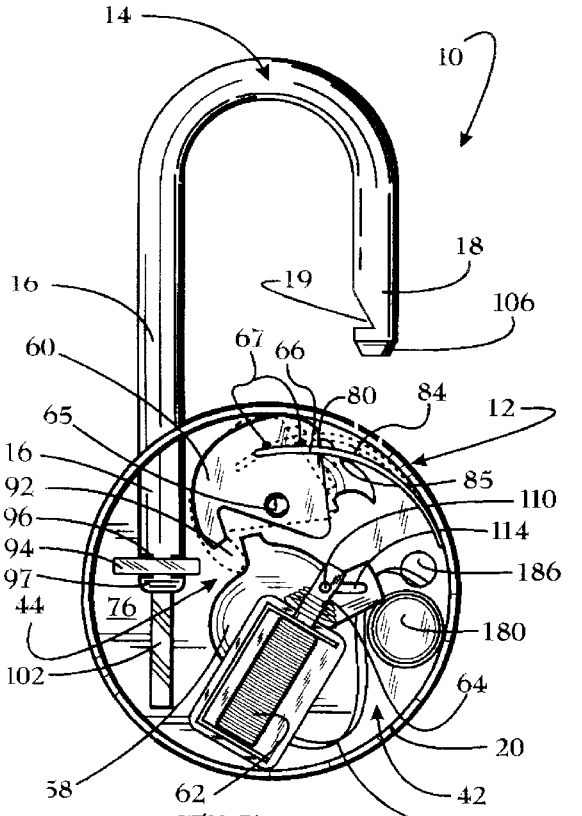
FIG. 12B is a rear elevational view, of the embodiment of FIG. 12A, showing the components of the lock release assembly disengaged from the end of the U-shaped lock bar, with the U-shaped lock bar pulled open, and thereby defining an unlocked condition.
Figure 13A:
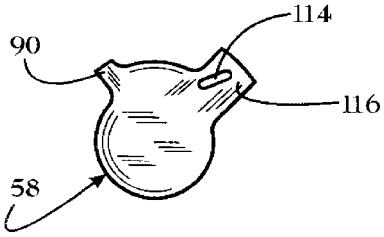
FIG. 13A is a top plan view of a cam in accordance with one embodiment of the invention.
Figure 13B:
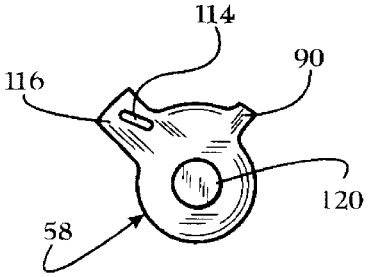
FIG. 13B is a bottom plan view showing the opposite side of the cam of FIG. 13A.
Figure 14A:
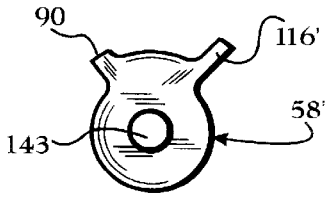
FIG. 14A is a top plan view of a cam in accordance with another embodiment of the invention.
Figure 14B:
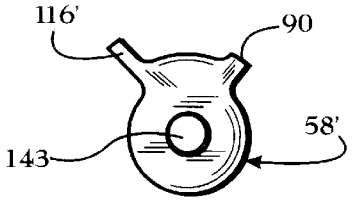
FIG. 14B is a bottom plan view showing the opposite side of the cam of FIG. 14A.
Figure 15A:
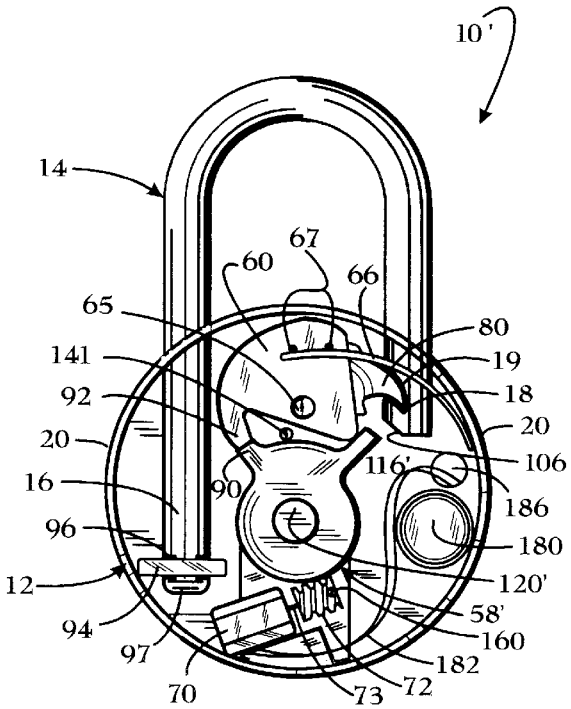
FIG. 15B is a rear elevational view of the embodiment of FIG. 15A showing the components of the lock release assembly in a released position, to thereby permit extension and removal of the U-shaped lock bar, and defining an open condition.
Figure 15B:
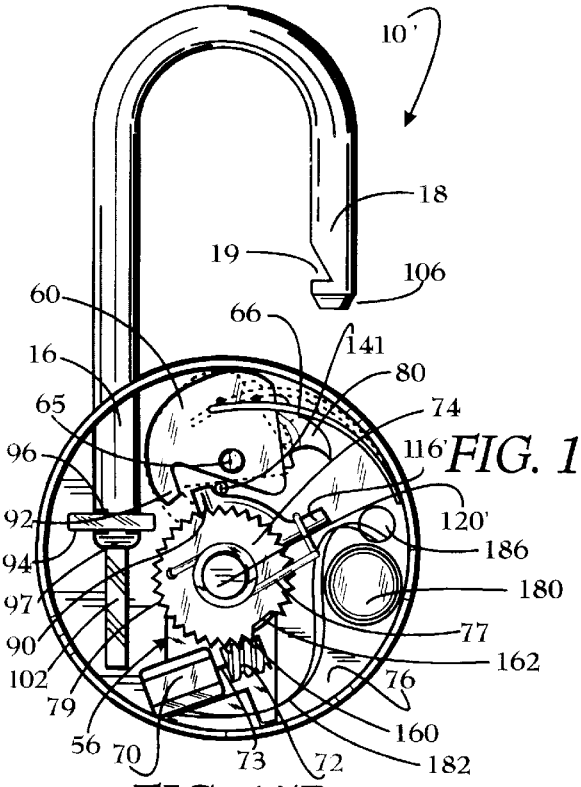

Upon entry of the correct code (either the factory code or personal PIN code), using the buttons 26, 27 and 28 on the front face, the microcontroller 50 signals actuation of the cam movement means 56, to thereby operate the lock release assembly 44. Rotational movement of the cam 58 permits movement of a locking lever 60 to disengage the end 18 of the lock bar 14. The movement means 56, for rotating the cam 58, may include various electromechanical devices in accordance with several embodiments of the invention, as shown throughout the several views of the drawings. Specifically, in one embodiment, a solenoid 62 with a spring loaded plunger 64, is provided, as seen in FIGS. 5, 12A and 12B, wherein retraction of the plunger against a spring serves to rotate the cam 58 in the clockwise direction to free the locking lever 60. In another embodiment, shown in FIGS. 15A–15B, a worm gear 72 driven by a 3 volt DC motor 70 is used to rotate a spur gear 74, as shown in FIGS. 6, 15A and 15B. In this embodiment, the spur gear 74 is coupled to the cam 58' by a spring 77 which urges the cam 58' through a partial rotation, both clockwise and counterclockwise, to engage and release the locking lever, thereby locking and unlocking the bar 14. These various embodiments of the lock release assembly 44 and cam movement means 56 are described in more detail hereinafter.

The microcontroller 50 is further used to store message data. The messages are shown in alphanumeric form on the display 32 upon successful entry of the combination code to open the lock. The message data may include: an advertisement prompting the user to purchase a specific product; the name of a business; a telephone number or internet website; or other information which may include both graphics and text.

Figure 9:
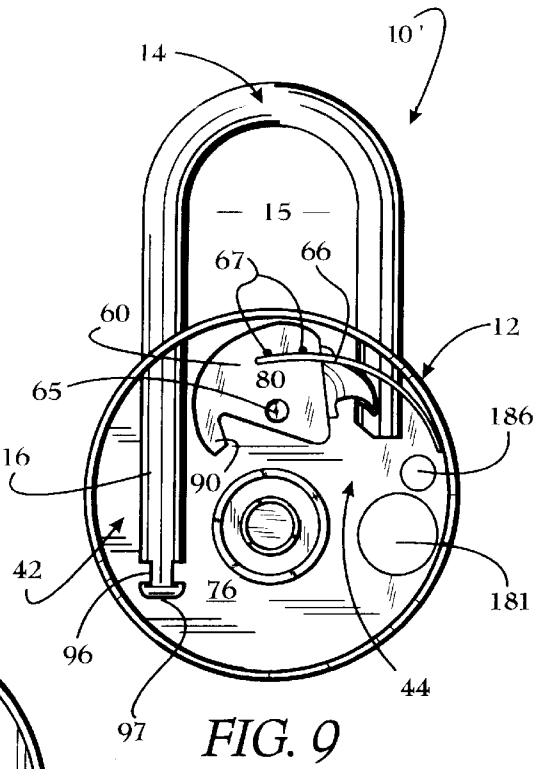
FIG. 9 is a rear elevational view of the embodiment of FIG. 8 with the back plate of the lock housing removed, showing the internal mechanical components therein.
Figure 8:
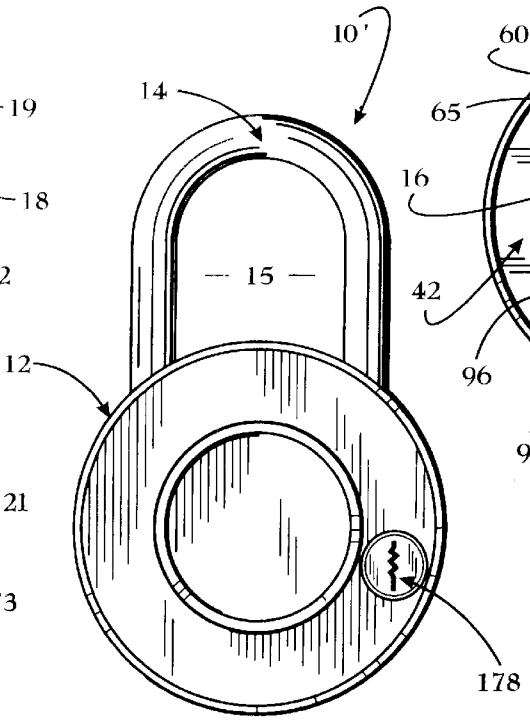
FIG. 8 is a rear elevational view of the electromechanical lock, in accordance with a further embodiment thereof, showing a key slot for opening the lock with a master key.
Figure 11:
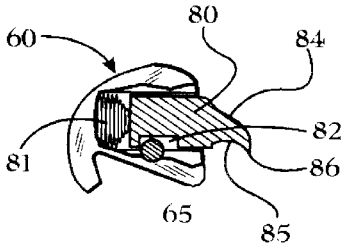
FIG. 11 is an isolated plan view, in partial section, showing a locking lever with a spring loaded catch for releasable, interlocking engagement with an opposite end of the lock bar within the housing.

In each of the various embodiments shown throughout the several views of the drawings, the lock release assembly 44 includes the lock lever 60 which pivots about a pin 65 fixed to an interior wall 76 of the housing. The lever 60 is normally urged to a closed position, into interlocked engagement with the lock bar 14, by a biasing element 66. One end of the biasing element 66 engages the inner surface of the side wall 20 of the lock housing 12. An opposite end section of the biasing element 66 is embedded within the side face of the lock lever 60 and engages dimples 67 pressed into the lock lever 60. The biasing element 66 urges the lever 60 in the clockwise direction, when viewed from the back (see FIGS. 9, 12A–12B, and 15A–15B). A stop element (not shown for purposes of clarity) limits clockwise movement of the lock lever 60 so that it is normally in the locked position, as seen in FIGS. 9, 12A and 15A. The lock lever 60 includes a claw 80 fitted within a cavity of the lock lever so that the claw 80 extends from the lock lever, as seen in FIG. 11. The claw 80 is urged to a normally extended position by a spring 81. The pivot pin 65, which extends through the lock lever, is positioned within a slot 82 formed along the base of the claw 80, limiting extended and retracted movement of the claw 80 within the cavity of the lever 60. The distal end of the claw is specifically shaped and configured for locked engagement with the notch 19 on the second end 18 of the lock bar 14, as seen in FIGS. 9, 12A and 15A. Specifically, the distal end of the claw includes a convex top surface 84 and a concave lower surface 85, with the concave and convex surfaces meeting at a downwardly oriented distal point 86.

The lock release assembly 44 further includes the cam 58, as mentioned above, which engages the lever 60 when the assembly 44 is in the locked position, to thereby secure the end of the lock bar 14 within the housing. Specifically, the cam 58 includes a knuckle 90 which is structured to engage a downwardly extending leg member 92 of the lever 60. The cam 58 is normally urged to a locking position, as seen in FIGS. 12A and 15A. In this position, the knuckle 90 engages the bottom of the leg member 92 of the lever, holding the lever 60 in the locked position. When the lock device 10, 10', 10" is initially opened, the cam 58 is rotated clockwise, by the movement means 56, releasing the leg member 92 of the lever 60 from engagement with the knuckle 90. This allows the lever 60 to rotate counterclockwise as the lock bar 14 is pulled outwardly from the housing and the claw 80 disengages the notch 19 of the lock bar 14. Thus, release of the lever 60 from the locked position, upon clockwise rotation of the cam 58, allows the lock bar to be pulled outwardly from the housing until the second end 18 of the lock bar clears the housing, thereby opening the lock 10. Once the distal end 106 of the lock bar 14 clears the claw 80, the lever 60 is urged back (clockwise) into the normally locked position by the biasing element 66.

Figure 10:
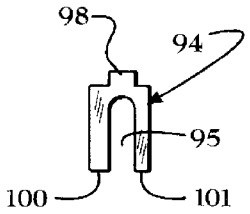
FIG. 10 is an isolated, top plan view of a traveler fitted to one end of the U-shaped lock bar for guiding movement of the end of the lock bar within the housing.

The opposite first end 16 of the lock bar is retained within the housing and is guided by a traveler 94 fitted about a reduced diameter portion near the end lock bar. Specifically, the traveler 94, as shown in FIG. 10, includes a U-shaped portion 95 which fits about the reduced diameter portion 96 adjacent the lock bar distal end 97. The traveler 94 further includes a guide element 98 which is received within a track 99 (see FIG. 4) formed on the back plate 21 of the lock. The opposite ends 100, 101 of the traveler, adjacent the opening of the U-shaped portion, are received on opposite sides of an elongate rail 102 fitted to an inner wall 76 surface of the lock. The traveler 94 permits upward and downward movement of the first end 16 of the lock bar 14, within the lock chamber 42, through a limited range of movement sufficient to permit the second end 18 of the lock bar to be moved upwardly to the open position, as seen in FIGS. 12B and 15B. The traveler further maintains the proper orientation of the lock bar, so that the lock bar moves in a fluid motion between the extended, open position and the closed, locked position enabling the second end 18 to be received through an opening 104 (see FIG. 3B) formed in the top portion of the outer cylindrical wall 20 of the housing and into the lock chamber 42 upon closing the lock bar 14.

When moving the lock bar 14 from the open position to the closed position, the second end 18 of the lock bar is received through the opening 104 formed in the housing wall. A tapered distal end 106 of the lock bar engages the convex surface 84 of the claw 80 of the locking lever, causing the claw 80 to be urged inwardly within the lever 60, against the force of the spring. Continued downward movement of the second end 18 of the lock bar 14 against the protruding claw 80 results in the claw eventually reaching the notch 19, whereupon the spring 81 urges the claw 80 outwardly and into locked engagement within the notch 19 on the end 18 of the lock bar 14.

In FIGS. 5, 12A and 12B, one embodiment of the cam movement means 56 is shown and includes a solenoid actuated plunger 64. The plunger 64 is fitted with a pin 110 extending transversely through a distal end zone 112 of the plunger 64 and into fitted attachment within a slot 114 formed in an arm 116 of the cam 58, as best seen in FIGS. 5, 12A–13B. The cam 58 includes an integral axle or mandrel 120 extending from a rear face thereof and into fitted receipt within a ballbearing spindle 122 which allows the mandrel 120 and cam 58 to rotate. The ballbearing spindle 122 is secured to the inner wall 76 of the housing and may be incorporated into a plug which is structured to press fit through a hole or opening in the wall 76. In a relaxed state, the plunger 64 is maintained in an extended position, as seen in FIGS. 5 and 12A. Upon entry of the correct combination code, the microcontroller 50 signals actuation of the solenoid 62 to retract the plunger 64 against the spring 124, causing the pin 112 to travel along the slot 114, and thereby urging the cam 58 in a clockwise direction to the position shown in FIG. 12B. This releases the knuckle 90 of the cam from engagement with the leg member 92, and thereby allows the locking lever 60 to rotate counterclockwise upon pulling the lock bar 14 outwardly from the housing so that the protruding claw 80 is released from the notch 19.

Referring to FIGS. 6, 7 and 14A–16, the cam movement means 56 is shown in accordance with a preferred embodiment thereof. In this embodiment, the cam movement means 56 includes an assembly comprising a motor 70, a worm gear 72, a spring 77 and a spur gear 74. More specifically, the worm gear 72 is fixed on an axle 73 which is driven by an electric 3 volt DC motor 70. The worm gear 72 is rotated through a series of revolutions, in either direction, upon actuation of the motor 70. The spur gear 74 is rotatably maintained on the mandrel 120' and is drivingly intermeshed with the worm gear 72. One end of the spring 77 is fitted through an aperture in the spur gear 74 in order to attach the spring 77 to the spur gear 74. An opposite end of the spring 77 attaches to the cam 58' in the manner shown in FIGS. 6, 7 and 15B. Thus, the spring 77 serves to couple the cam 58' to the spur gear 74 so that when the spur gear 74 is rotated in both the clockwise and counterclockwise directions, a turning force is loaded in the spring 77 to thereby carry the cam 58' in the same direction as the spur gear 74.

Figure 16:
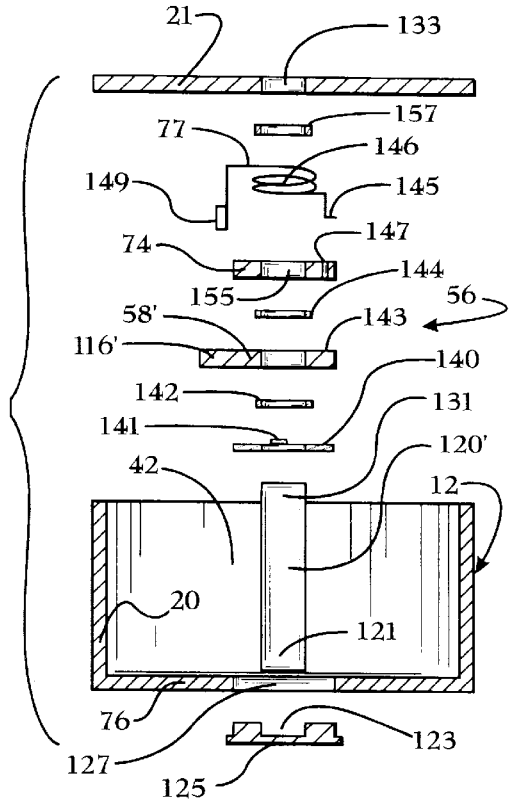
FIG. 16 is an exploded bottom view, in cross-section, illustrating assembly of the component elements of the lock release assembly in accordance with one embodiment thereof.

Referring to FIG. 16, the assembly of the cam movement means 56, in accordance with this preferred embodiment, is shown in an exploded view. Specifically, the mandrel 120' includes a first end 121 which is fixed within a socket 123 on the inner dividing wall 76. In one particular embodiment, the socket 123 may be provided on a retainer plug 125 which is press fit within a hole 127 formed through a center of the dividing wall 76. The mandrel 120' extends generally perpendicular to the dividing wall 76 and rearwardly to the back plate 21. An opposite end 131 of the mandrel is press fit within an aperture or socket 133 on the back plate so that the mandrel 120' is maintained in fixed position extending through the lock chamber 42 in perpendicular relation to the dividing wall 76 and back plate 21. A bracket 140 is fitted about the mandrel 120' and against the retainer 125 and/or the dividing wall 76. The bracket 140, in a preferred embodiment, is secured to an inner surface of the cylindrical wall 20, preventing movement thereof, and provides means for mounting the motor 70 so that the shaft 73 of the motor and worm gear 72 thereon are properly aligned and spaced relative to the mandrel 120'. More specifically, the bracket 140 serves to locate and mount the motor 70 in proper orientation, at a precise location so that the worm gear 72 intermeshes in driven engagement with the teeth 79 on the spur gear 74. The bracket 140 further includes a stop post 141 which extends upwardly from the brackets and rearwardly in the lock chamber to thereby provide a cam stop means, as described more fully hereinafter. The cam 58' is rotatably received on the mandrel 120', just rearward of spacer 142. The spacer 142 between the bracket 140 and cam 58' prevents frictional engagement of the cam 58' against the bracket 140 and the surface of the dividing wall 76. An aperture 143 formed through the cam 58' is sized and configured for receipt of the mandrel 120' therethrough so that the cam 58' is able to rotate about the mandrel. A second spacer 144 is fitted to the mandrel 120', between the cam 58' and the spur gear 74. The spring 77 includes a coiled section 146 which is received about the mandrel 120' just rearward of the spur gear 74. A first end 145 of the spring 77 is received through aperture 147 in the spur gear 74 and an opposite end 149 of the spring is fitted to the arm 116' of the cam 58'. Alternatively, the end 149 of the spring 77 may be fitted through an aperture in the cam 58' in the same general manner as the opposite end is fitted to the spur gear. The spur gear 74 is provided with a central hole 155 which is sized and disposed for receipt of the mandrel 120' therethrough so that the spur gear 74 is able to rotate freely about the mandrel. A retainer 157 is press fit to the end 131 of the mandrel 120' to captivate the spring coil 146 between the retainer 157 and the spur gear 74, thereby maintaining the components of the cam movement means 56 on the mandrel when the back plate 21 is removed. The spring 77 couples the spur gear 74 to the cam 58' and also acts as a compression spring to urge the spur gear 74 inwardly, away from the back plate 21 and retainer 157, so that the teeth 79 of the spur gear 74 are maintained in intermeshed, driven engagement with the worm gear 72. The spring 77 further allows the spur gear 74 to be rotatably adjusted relative to the lever 60. Specifically, the spur gear 74 can be pulled outwardly, towards the back plate 21, to disengage the teeth 79 from the worm gear 72 so that the spur gear can be rotatably adjusted either clockwise or counterclockwise and reset back into intermeshed, driven engagement with the worm gear 72. This is particularly important to permit adjustment of the cam 58' relative to the lever 60 and cam stop means defined by the stop post 141 maintained between the knuckle 90 and the arm 116' of the cam 58'. More specifically, in the locked position the knuckle 90 of the cam 58' is maintained in aligned, abutting engagement with the extending leg member 92 of the lock lever 60. Upon completion of entry of the correct combination code, as described above, and actuation of the motor 70 to turn the worm gear 72, the spur gear 74 is rotated clockwise through a predetermined, partial rotational movement. This results in the spring 77 becoming loaded to thereby urge the cam 58' in the same clockwise direction as the spur gear 74. If, for any reason, the cam 58' becomes temporarily jammed or obstructed from rotating, then the load on the spring 77 will be stored until the cam 58' is freed and able to move, at which point the spring 77 will urge the cam 58' in the same direction of movement (clockwise or counterclockwise) as the spur gear's last movement. Clockwise rotation of the cam 58' is limited by the stop post 141. Specifically, the stop post 141 on the bracket 140 engages the knuckle 90 on the cam 58', thereby stopping clockwise rotation of the cam 58' at the position shown in FIG. 15B. In this position, the knuckle 90 of the cam is moved out of blocking engagement with the extending leg member 92 of the lock lever 60, thereby permitting the lock lever to rotate in a counterclockwise direction, against the biasing element 66 (as represented by the phantom lines in FIG. 15B) upon pulling of the lock bar 14 from the housing. As described above, once the distal end 106 of the lock bar clears the claw 80, the lock lever 60 is urged back to the locked position, by biasing element 66.

After a predetermined time delay (approximately 5–10 seconds), the motor 70 is again activated to drivingly rotate the spur gear 74 in the opposite (counterclockwise) direction so that the cam 58' is carried back to the locked position shown in FIG. 15A. Thus, the spring 77 provides several functions. Specifically, the spring 77 couples the spur gear 74 to the cam 58' so that when the spur gear is rotated, either clockwise or counterclockwise, the cam is urged in the same direction, with motion of the cam being limited by cam stop means. The spring 77 further urges the spur gear into intermeshed engagement with the worm gear and permits removal of the spur gear from intermeshed engagement in order to adjust positioning of the spur gear.

In order to prevent over rotation of the worm gear, a second stop means is provided. Specifically, the worm gear 72 includes a protruding peg 160 which is specifically structured and disposed for engaging the spur gear to limit rotation of the worm gear. More particularly, the spur gear is provided with a notched portion 162 which permits passage of the peg 160 therethrough as the worm gear rotates. Continued rotation of the spur gear, driven by the worm gear, moves the notched portion relative to the peg 160 until, eventually, the stop peg 160 engages the outer face or inner face of the spur gear, adjacent the opposite ends of the notched portion. Thus, rotational movement of the worm gear, as well as the spur gear, is specifically limited in accordance with the size of the notched portion 162 and the distance of travel of the stop peg 160 relative to the notched portion 162. The stop means defined by the worm gear and spur gear, as well as the cam stop means, serve to specifically control movement of the worm gear 72, spur gear 74, and cam 58' so that the gears 72, 74, cam 58' and lever 60 are maintained in proper alignment each time the lock release means 44 is operated between the open and closed positions. More specifically, the cam stop means and the worm gear stop means serve to insure that the cam 58' is moved between locked engagement with the lever and disengagement with the lever, each time the motor 70 is energized to open and close the lock.

In order to conserve energy in the power cell 52, a capacitor 180 is provided. In a preferred embodiment, the capacitor is connected to the PC board 51 in the electronics chamber 40 which also houses the microcontroller 50. The capacitor 180 extends rearwardly from the PC board, through a hole 181 formed in the dividing wall 76 and into the lock chamber 42. Conductors 182 interconnect with the PC board 51 and the motor 70 or solenoid 62, in either of the above-described embodiments, for delivering energy thereto upon actuation of the lock release means 44. More specifically, upon entry of the proper combination, the motor 70 or solenoid 62 receive an impulse by the capacitor 180 to thereby operate the motor 70 or solenoid 62, as described above. Use of the capacitor 180 serves to substantially extend the life of the power cell 52, insuring that the motor 70 or solenoid 62 do not draw energy directly from the power cell 52. As seen in FIGS. 12A and 15A, the conductors 182 may be fed through a hole 186 in the dividing wall 76 to permit interconnection of the conductors 182 between the PC board 51 and the motor 70 or solenoid 62.

Figure 3A:
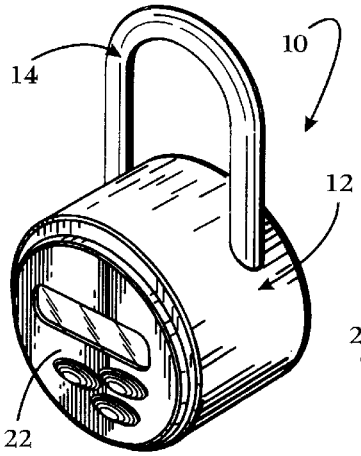
FIG. 3A is a front perspective view illustrating one embodiment of the electromechanical lock.
Figure 3B:
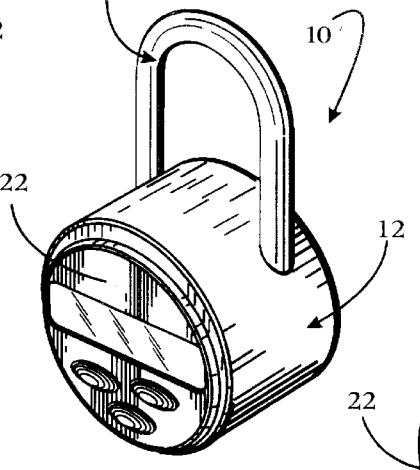
FIG. 3B is a front perspective view of another embodiment of the electromechanical lock.
Figure 3C:
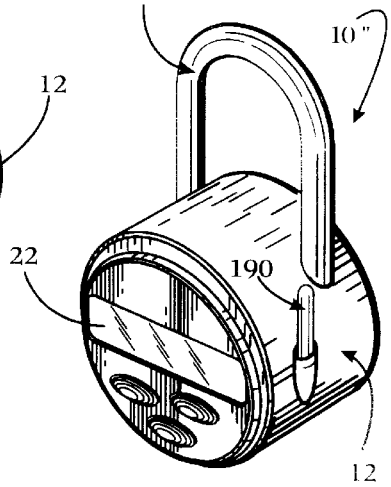
FIG. 3C is a front perspective view of yet another embodiment of the electromechanical lock.
Figure 4:
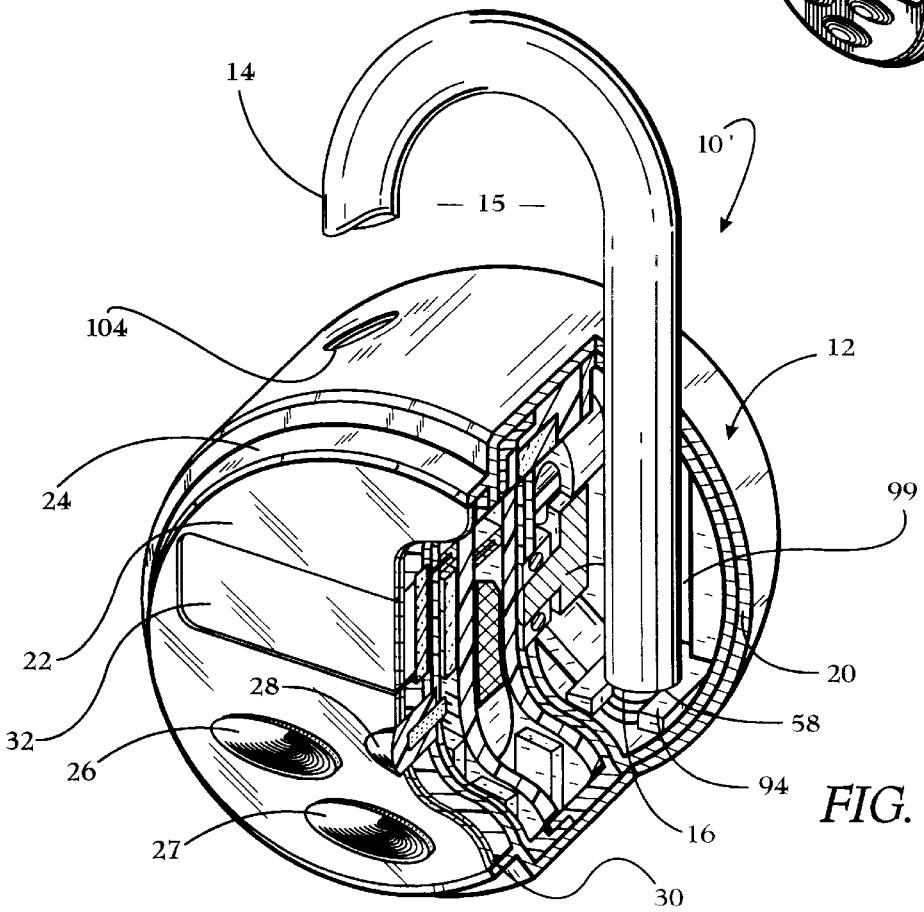
FIG. 4 is a front perspective view, in partial section, showing the internal components and structure of the electromechanical lock of the embodiment of FIG. 3B.
Figure 7:
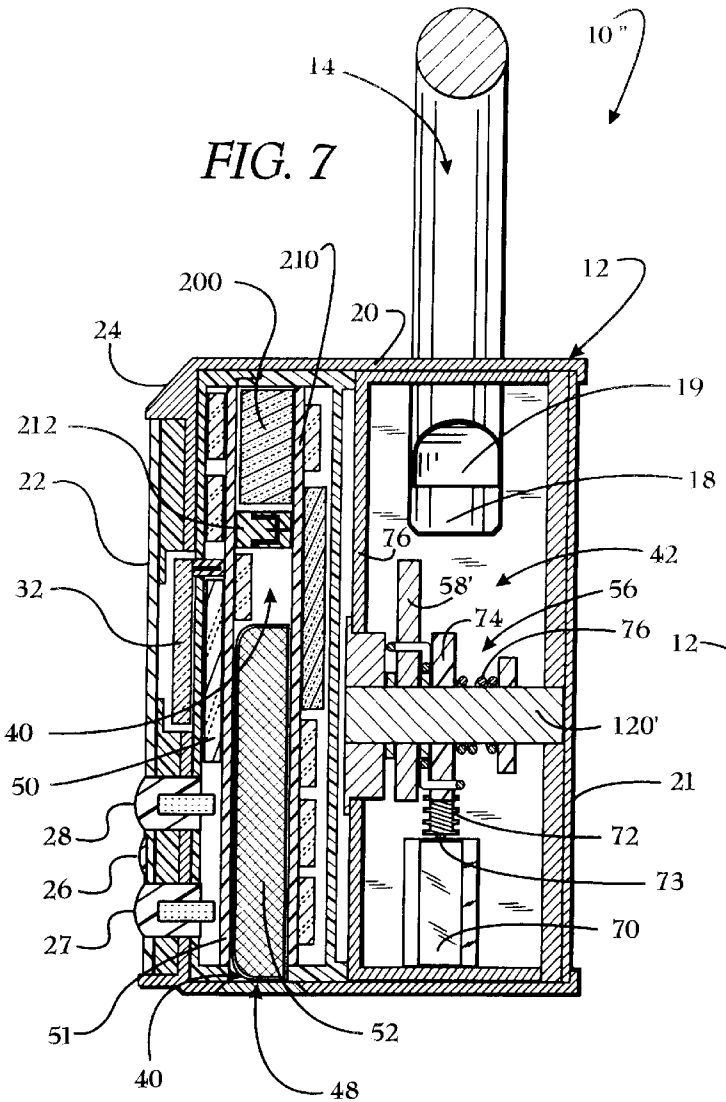
FIG. 7 is a side elevation, in cross section, showing the internal components of the electromechanical lock of the embodiment of FIG. 3B incorporating a motor and worm gear arrangement for moving a cam of the locking assembly and further incorporating an alternative arrangement of components therein.
Figure 19:
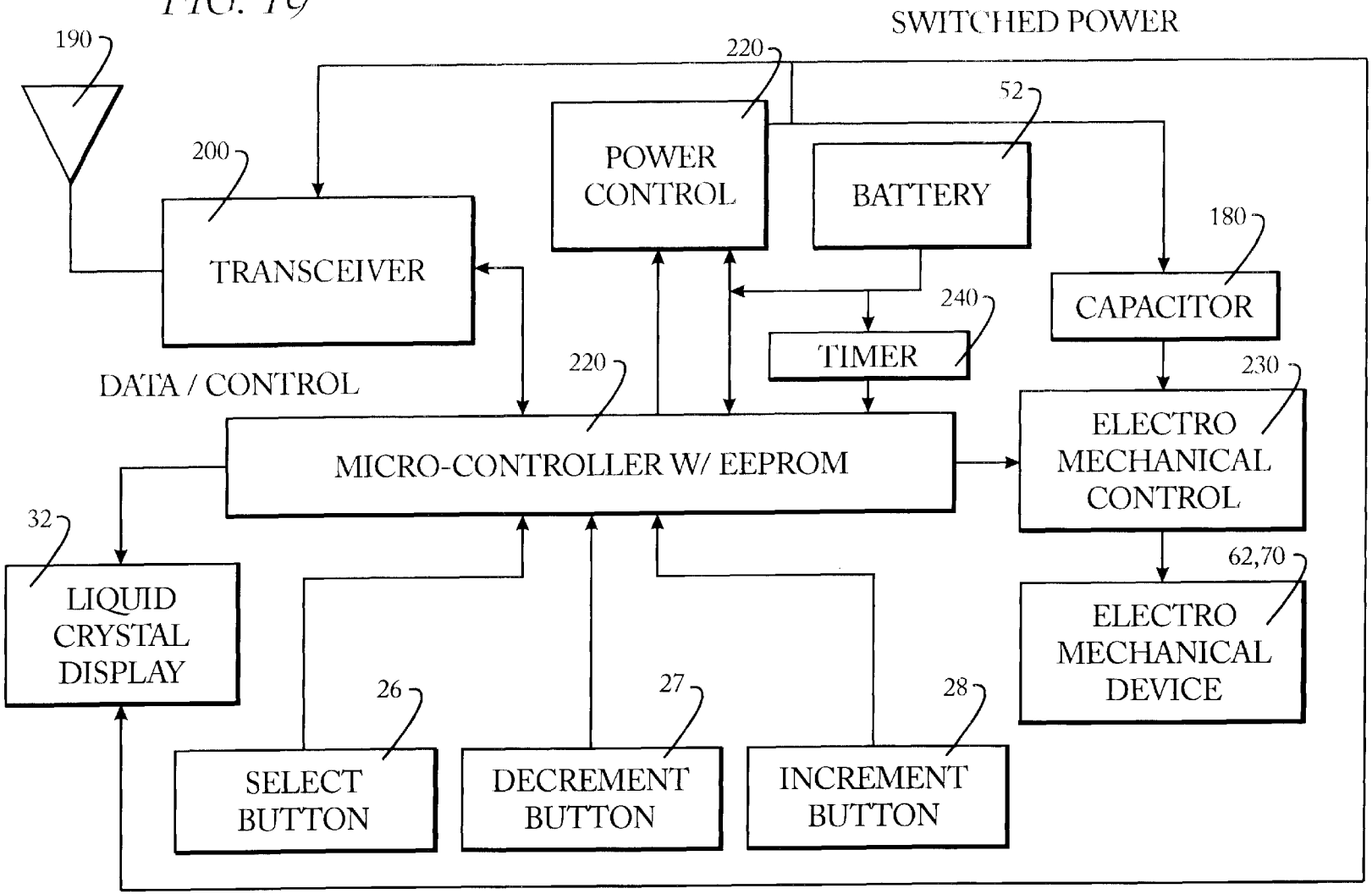
FIG. 19 is a schematic block diagram of the electronic circuitry of the embodiment of FIG. 3C.

Referring to FIG. 19, a sequence of operation of the electronic components of the lock device 10" is shown in block diagram form, in accordance with the embodiment of FIGS. 3C and 7. Specifically, this embodiment of the lock device 10" incorporates means for wireless communication with a remote station to allow for changing and/or updating of stored message data and to further enable remote programming and manipulation of data stored on the microcontroller 50. To facilitate wireless communication, the lock device 10" is provided with a transceiver 200 and antenna 190. The transceiver is structured to send and receive RF signals, or other wireless signals, between the device 10" and the remote programming station. The transceiver 200 communicates with the microcontroller 50 and the LCD 32. Thus, encrypted message data, programming data, and other data can be delivered to a plurality of the lock devices 10', by RF communication or other wireless communication means. This facilitates updating, changing and replacing of messages which are stored on the microcontroller and displayed each time the lock device 10' is opened by the user. The provider of the lock device 10" can, thereby, periodically update the data, and manipulate data stored on the microcontroller at selected time intervals (e.g., late in the evening or early in the morning).

With the exception of the antenna 190 and transceiver 200, the remaining components shown in FIG. 19 are found in each of the embodiments of the invention. A power control 220 communicates with the microcontroller 50 to control the supply of power to the remaining components, thereby providing a means for augmenting energy conservation. The power control 220 is located and integrated into the electronics of the device and acts as a switching mechanism to control delivery of electric power to the various electronic components. As depicted in FIG. 19, the power control 220 can simultaneously or independently be switched on or off to control delivery of electric power from the battery 52 (power cell) to the electronic components, including the transceiver 200, LCD 32, and electromechanical control 230, via commands from the microcontroller 50. In particular, the transceiver 200, when energized via prescribed commands from the microcontroller 50, is allocated a predetermined time frame in order to receive wireless communication signals which are directed to the device from a remote source (e.g., a provider of the lock). This is accomplished by a timing circuit 240 which contains crystal for keeping extremely accurate time.

The timing circuit 240 tracks time, in accordance with the time zone location of the device, so that the microcontroller can command the transceiver 200 to "wake up" at the prescribed times for receiving signals. Thereafter, the transceiver returns to a sleep mode so that power is not drained from the battery 52. If necessary, an adjustment or resetting of the time kept by the timer 240 can be accomplished via wireless data inputs received through the transceiver 200 from the remote source. In the event the device 10 is relocated to a different time zone, wherein the transceiver 200 would otherwise not be awakened to receive signals, a prescribed longer receiving envelope is allowed. In this instance, the microcontroller would awaken the transceiver 200 for an extended period in order to receive signals in the new time zone. This extended receiving envelope allows the device to receive data transmitted in the new time zone. When the new data is assimilated, the microcontroller 50 resets the internal clock 240 to the new time zone and applies the additional data appropriately and returns the transceiver 200 to the sleep mode. Alternatively, the time, tracked by the timer 240, can be reset to the new time zone via wireless commands or hard wired commands at the time of transfer, in which case the microcontroller 50 will command the transceiver to be energized (i.e., awakened) at the prescribed time within that particular time zone, thereby ensuring that the signals from the remote source are received.

The LCD 32 is energized by the power control 220 at prescribed intervals, as allocated by commands by the microcontroller 50. This further serves to conserve power, thereby extending the life of the battery 52.

The capacitor 180 is supplied with a prescribed level of electric energy at prescribed times through the power control 220, via commands from the microcontroller 50. Upon completion of entry of the correct combination code, the microcontroller commands the electromechanical control 230 to release electrical energy to the solenoid 62 or motor 70, in accordance with the various embodiments of the invention as described above. Thus, the electromechanical control 230 acts as a switching mechanism that takes commands from the microcontroller 50 and allows dispersement of the stored energy from the capacitor, all at once, to the electromechanical device 62, 70. With respect to the motor 70, the electromechanical control 230 is structured to send the stored supply of electric energy from the capacitor 180 to the motor 70 for clockwise or counterclockwise rotation. Thus, control of the direction of electric current flow to the motor 70 by the electromechanical control 230, via commands from the microcontroller 50, serves to operate the motor to rotate the motor shaft and worm gear in the required clockwise and/or counterclockwise direction.

Figure 20:
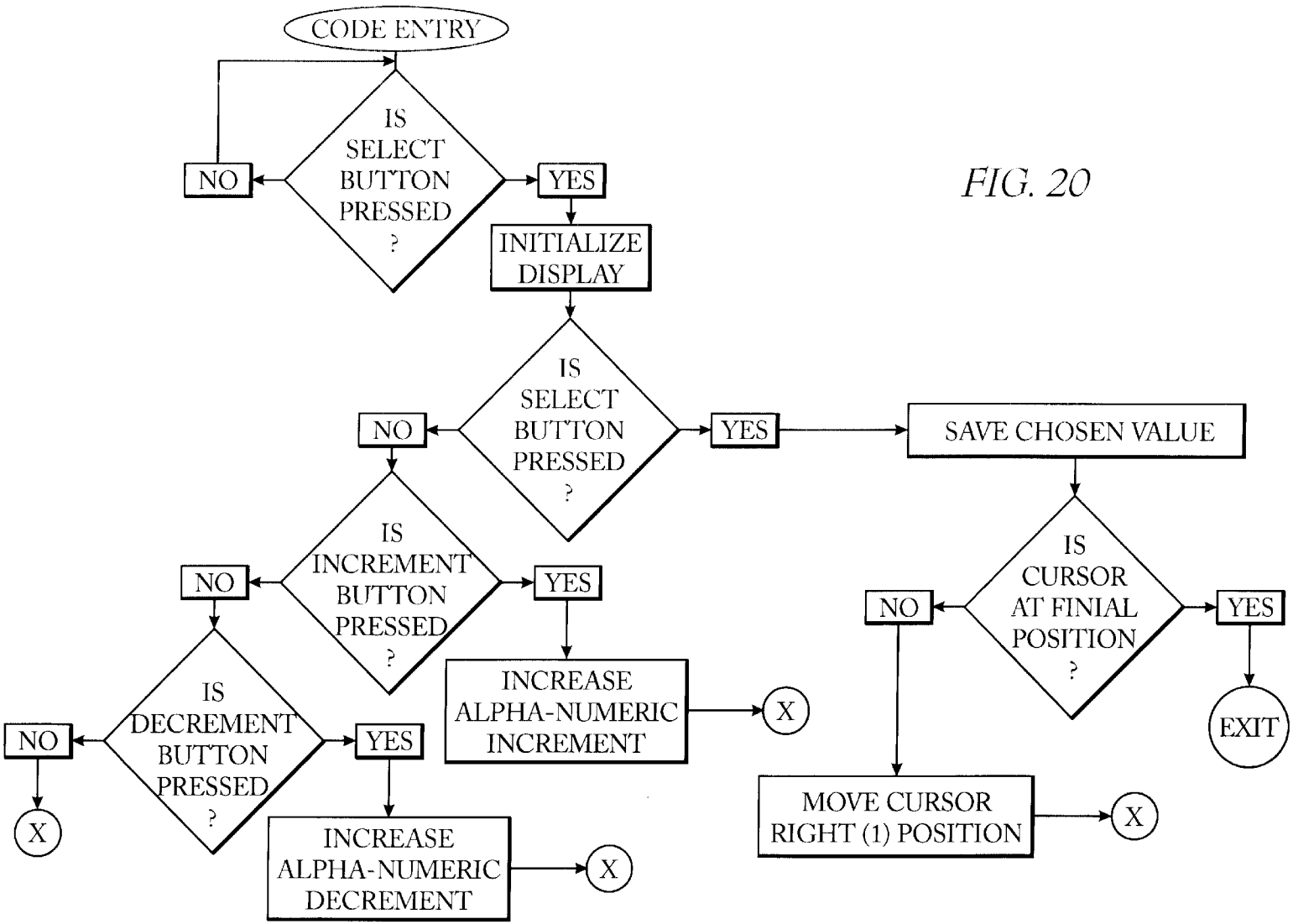
FIG. 20 is a flow chart indicating steps of operation in the use of the electromechanical lock of the present invention.
Figure 21:
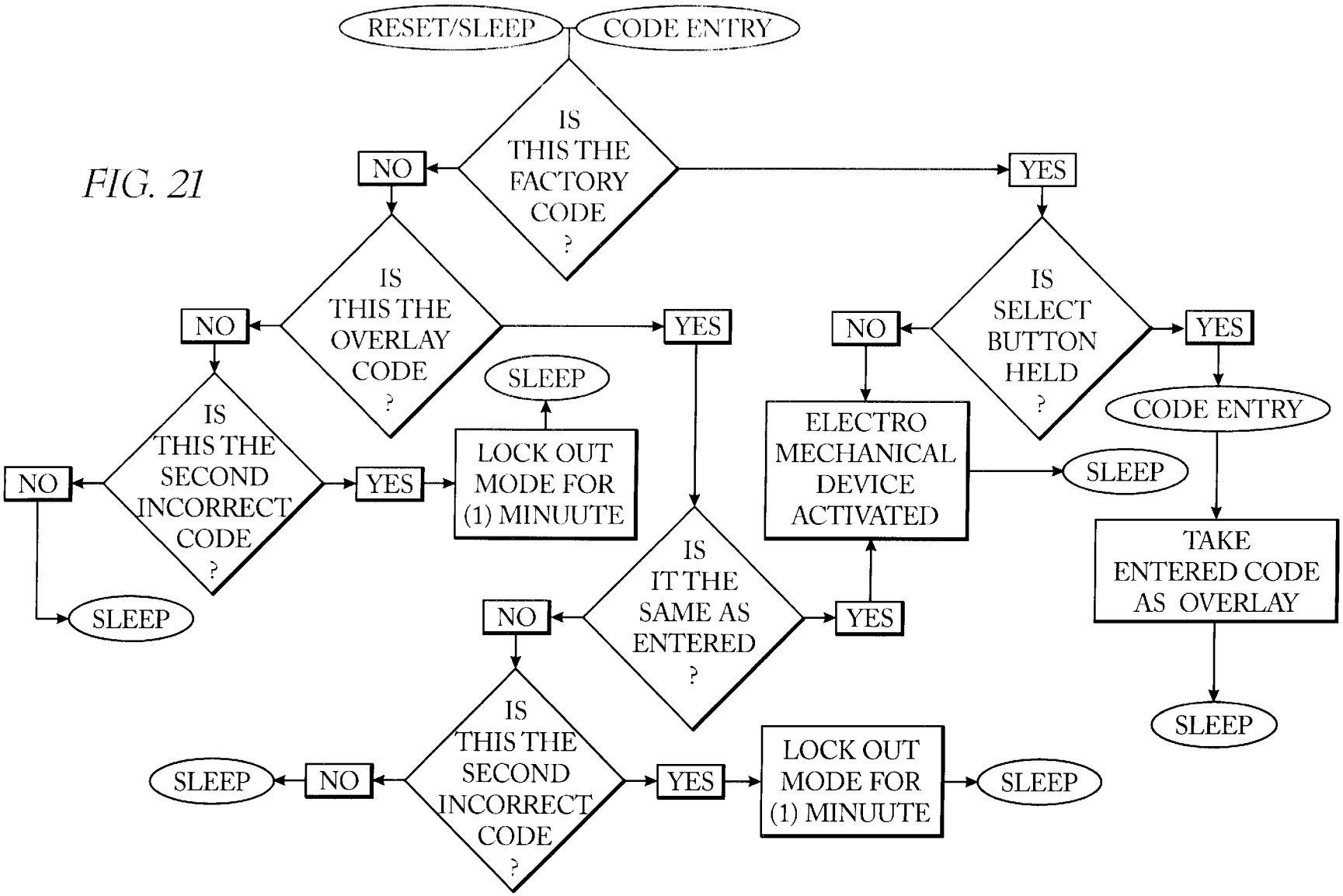
FIG. 21 is another flow chart, indicating steps of operation in the use of the electromechanical lock in accordance with another embodiment of the invention.

FIG. 20 illustrates a sequence of operational steps, in the programmed logic, for programming a PIN code which overlays the factory code. FIG. 21 illustrates a sequence of operational steps, in accordance with the programmed logic on the microcontroller, for entering and identifying a correct code to open the lock device 10, 10', 10", in each of the embodiments thereof.

While the instant invention has been shown and described in accordance with preferred and practical embodiments thereof, it is recognized that departures may be made from the instant disclosure which, therefore, should not be limited except as set forth in the following claims as interpreted under the doctrine of equivalents.

What is claimed is:

1. An electromechanical lock device comprising:

a housing containing a plurality of components including electronic and electromechanical components and said housing including a front face;

a lock bar including a first end portion and a second end portion, said lock bar being movable in relation to said housing between an open position defined by said second end portion being removed from said housing and a closed position defined by said second end portion being inserted within said housing;

button means for entering a combination code;

display means on said front face for displaying said combination code during entry thereof, and said display means being further structured and disposed for displaying messages;

a lock release assembly comprising:

a locking lever pivotally movable about an axis between a locking position and a release position, and said locking lever including a catch member structured and disposed for interlocking engagement with said second end portion of said lock bar to hold said lock bar in a locked position when said locking lever is in said locking position and said lock bar is in said closed position, and said catch member being removed from said interlocking engagement with said second end portion of said lock bar when said locking lever is moved to said release position to permit movement of said lock bar to said open position;

biasing means for urging said locking lever to said locking position;

a cam rotatably supported on an axle and being rotatable between a first position and a second position, said first position being defined by said cam disposed in engagement with said locking lever to hold said locking lever in said locking position and to prevent movement of said locking lever to said release position, and said second position being defined by said cam being released from engagement with said locking lever to permit movement of said locking lever against said biasing means and to said release position; and cam movement means for rotating said cam between said first and second positions;

control means for controlling operation of said electronic and electromechanical components of said lock device including said display means and said cam movement means, and said control means being structured and disposed to actuate said cam movement means in operation of said lock release assembly in order to permit movement of said locking lever to said release position upon entry of a predetermined correct combination code using said button means, thereby permitting movement of said lock bar to said open position;

said control means including memory means for storing data including said predetermined correct combination code and said messages; and power means for storing and supplying electrical power to said electronic and electromechanical components.

2. The lock device as recited in claim 1 wherein said lock bar includes a U-shaped configuration with said first end portion being movably retained within said housing and said opposite second end portion having a notch formed therein in spaced relation to a distal end, said notch being structured and disposed for interlocking engagement with said catch member of said locking lever means.

3. The lock device as recited in claim 1 further including means for programming at least one user selected combination code.

4. The lock device as recited in claim 3 wherein said combination code includes a permanently installed combination code and said at least one user selected combination code.

5. The lock device as recited in claim 1 wherein said display means includes a graphic liquid crystal display.

6. The lock device as recited in claim 5 wherein said display means is structured to display alphanumeric characters and wherein said combination code and said messages include use of alphanumeric characters.

7. The lock device as recited in claim 6 further including means for scrolling through said alphanumeric characters displayed on said display means when entering said combination code using said button means.

8. The lock device as recited in claim 1 further including power control means for conserving the electrical power stored in said power means.

9. The lock device as recited in claim 1 wherein said power means includes at least one replaceable Lithium 3VDC power cell.

10. The lock device as recited in claim 9 wherein said at least one power cell is held within a carriage, said carriage being hingedly fitted to said housing and being structured and disposed to move between a closed position, maintaining said power cell within an interior of said housing, and an open position, wherein said power cell and said carriage are pulled outwardly from said housing to thereby facilitate removal and replacement of said power cell.

11. The lock device as recited in claim 10 further comprising auxiliary power supply means including:

an auxiliary power supply pack including a port for removable placement of a power cell therein, and conductor means interconnecting said pack to a plug; and a power supply port on the lock device, said power supply port being structured and disposed for interconnection of said plug thereto, to thereby facilitate transfer of electrical power from said power cell in said power pack to said electronic and electromechanical components of the lock for operation thereof.

12. The lock device as recited in claim 1 further including wireless communication means for remotely programming and manipulating said data stored in said memory means.

13. The lock device as recited in claim 12 wherein said wireless communication means is further structured for remotely changing and updating said messages for subsequent display on said display means.

14. The lock device as recited in claim 13 wherein said wireless communication means includes a transceiver and an antenna for receipt and transmission of said data via wireless communication signals.

15. The lock devices recited in claim 1 wherein said control means includes a programmable microcontroller provided with electronically erasable programmable random access memory.

16. An electromechanical lock device comprising:

a housing containing a plurality of components including electronic and electromechanical components and said housing including a front face;

a U-shaped lock bar including a first end portion movably retained in said housing and an opposite second end portion, said U-shaped lock bar being movable in relation to said housing between a closed position wherein the second end portion is captivated within said housing and an open position wherein said second end portion is removed from said housing;

button means for entering a combination code;

a display for displaying indicia including messages;

a lock release assembly comprising:

a locking lever pivotally movable about an axis between a locking position and a release position, and said locking lever including a catch member structured and disposed for interlocking engagement with said second end portion of said lock bar to hold said lock bar in a locked position when said locking lever is in said locking position and said lock bar is in said closed position, and said catch member being removed from said interlocking engagement with said second end portion of said lock bar when said locking lever is moved to said release position to permit movement of said lock bar to said open position;

biasing means for urging said locking lever to said locking position;

a cam rotatably supported on an axle and being rotatable between a first position and a second position, said first position being defined by said cam disposed in engagement with said locking lever to hold said locking lever in said locking position and to prevent movement of said locking lever to said release position, and said second position being defined by said cam being released from engagement with said locking lever to permit movement of said locking lever against said biasing means and to said release position; and cam movement means for rotating said cam between said first and second positions;

control means for controlling operation of said electronic and electromechanical components of said lock device including said display means and said cam movement means, and said control means being structured and disposed to actuate said cam movement means in operation of said lock release assembly in order to permit movement of said locking lever to said release position upon entry of a predetermined correct combination code using said button means, thereby permitting movement of said lock bar to said open position;

said control means including memory means for storing data including said predetermined correct combination code and said messages; and power means for storing and supplying electrical power to said electronic and electromechanical components.

17. The lock device as recited in claim 16 further including means for programming at least one user selected combination code to be said predetermined correct combination code.

18. The lock device as recited in claim 16 wherein said display is a graphic liquid crystal display.

19. The lock device as recited in claim 16 further including wireless communication means for remotely programming and manipulating said data stored in said memory means, and said wireless communication means being further structured for remotely changing and updating said messages for subsequent display on said display.

20. The lock device as recited in claim 19 wherein said wireless communication means includes a transceiver and an antenna for receipt and transmission of said data via wireless communication signals.

21. An electromechanical lock device comprising:

a housing containing a plurality of components including electronic and electromechanical components and said housing including a front face;

a lock bar including a first end portion and a second end portion, said lock bar being movable in relation to said housing between an open position defined by said second end portion being removed from said housing and a closed position defined by said second end portion being inserted within said housing;

button means for entering a combination code;

display means on said front face for displaying said combination code during entry thereof, and said display means being further structured and disposed for displaying messages;

a lock release assembly comprising:

a locking lever pivotally movable about an axis between a locking position and a release position, and said locking lever including a catch member structured and disposed for interlocking engagement with said second end portion of said lock bar to hold said lock bar in a locked position when said locking lever is in said locking position and said lock bar is in said closed position, and said catch member being removed from said interlocking engagement with said second end portion of said lock bar when said locking lever is moved to said release position to permit movement of said lock bar to said open position;

biasing means for urging said locking lever to said locking position;

a cam rotatably supported on an axle and being rotatable between a first position and a second position, said first position being defined by said cam disposed in engagement with said locking lever to hold said locking lever in said locking position and to prevent movement of said locking lever to said release position, and said second position being defined by said cam being released from engagement with said locking lever to permit movement of said locking lever against said biasing means and to said release position; and cam movement means for rotating said cam between said first and second positions;

control means for controlling operation of said electronic and electromechanical components of said lock device including said display means and said cam movement means, and said control means being structured and disposed to actuate said cam movement means in operation of said lock release assembly in order to permit movement of said locking lever to said release position upon entry of a predetermined correct combination code using said button means, thereby permitting movement of said lock bar to said open position;

said control means including memory means for storing data including said predetermined correct combination code and said messages;

wireless communication means for remotely programming and manipulating said data stored in said memory means, and said wireless communication means being further structured for remotely changing and updating said messages for subsequent display on said display means; and power means for storing and supplying electrical power to said electronic and electromechanical components including said display means, said cam movement means, said control means, and said wireless communication means.

* * * * *